United States Patent [19]

Luff

[11] 4,102,500

[45] Jul. 25, 1978

[54] APPARATUS FOR SPRAYING LIQUIDS

[75] Inventor: Stanley Herbert Luff, Hull, England

[73] Assignee: Humbrol Limited, Hull, England

[21] Appl. No.: 748,014

[22] Filed: Dec. 6, 1976

[30] Foreign Application Priority Data

Dec. 9, 1975 [GB] United Kingdom ..... 50341/75

[51] Int. Cl.[2] ..... B05B 7/12

[52] U.S. Cl. ..... 239/345; 239/417.3; 239/530; 239/583

[58] Field of Search ..... 239/341, 345, 346, 353, 239/354, 379, 414, 415, 426, 526, 527, 528, 583, 456, 417.3, 530; 251/229, 251

[56] References Cited

U.S. PATENT DOCUMENTS

| | | | |
|---|---|---|---|
| 595,931 | 12/1897 | Wold | 239/414 |
| 649,431 | 5/1900 | Burdick | 239/345 |
| 814,218 | 3/1906 | Krautzberger | 239/345 |
| 1,272,752 | 7/1918 | Wold | 239/345 X |

FOREIGN PATENT DOCUMENTS

| | | | |
|---|---|---|---|
| 406,479 | 1/1910 | France | 239/345 |

*Primary Examiner*—John J. Love
*Attorney, Agent, or Firm*—Fred Philpitt

[57] ABSTRACT

A spray gun or air brush is disclosed and comprises a spray jet having a delivery orifice fed from a liquid reservoir, an air jet located in the vicinity of the spray jet, and means for conducting pressure air from a source to the air jet to cause a stream of air past the spray jet whereby a negative pressure induced in the latter draws liquid into the air stream. An air valve is arranged in the means for conducting pressure air so as to control the passage of air to the air jet, and manually adjustable cam means, adapted to co-operate with a control valve incorporated in the spray jet, are provided to control the size of the delivery orifice and to control variation of the size of the orifice in a predetermined manner.

1 Claim, 2 Drawing Figures

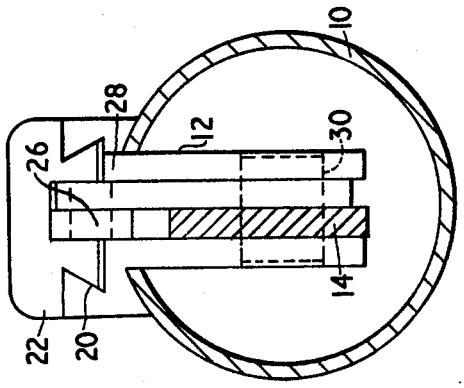
—FIG. 2—
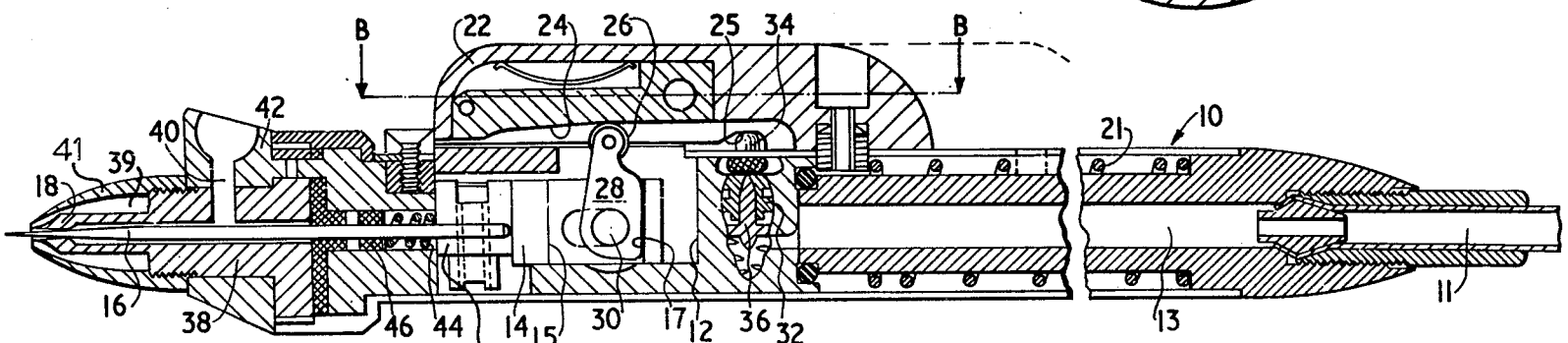
—FIG. 1—

APPARATUS FOR SPRAYING LIQUIDS

This invention concerns apparatus for spraying liquids and relates more particularly to spray guns and to so-called air brushes.

Spray guns usually comprise a liquid reservoir closed by a cap or equivalent member constituting a spray head and carrying a liquid spray nozzle fed by a tube depending therefrom into the reservoir, an air jet positioned adjacent the spray jet and means for feeding pressure air from a suitable source to the air jet to cause a collimated flow or stream of air past the end of the spray jet whereby a negative pressure induced in the latter draws liquid from the reservoir and into the air stream wherein it is entrained as minute droplets. In the case of an air brush, a principal difference from a spray gun is that sometimes the brush, which carries the spray nozzle, is remote from the reservoir closure cap and has a flexible connection to the dependent tube. It is usual in such spray gun or air brush constructions to provide a valve in the air flow path to admit pressure air to or to prevent it from reaching the air jet, according to requirements and a trigger, push button or other member for actuating such valve is so positioned as to be operable by finger pressure.

Spray guns and air brushes as described in the preceding paragraph hereof will hereinafter be referred to as being spray guns and air brushes of the type described.

The shape and composition of the spray delivered by the spray jet is a function of the relative position of and spacing between the spray jet and the air jet together with the rate of flow of the pressure air, and also of the size of the delivery orifice which the spray jet presents to the liquid drawn from the reservoir.

It is known to adjust the size of the delivery orifice by means of a valve having a manually controlled closure member, the size of the orifice being dependent upon the position of the closure member. However, movement of the closure member has hitherto been directly related to the manual action so that a considerable degree of skill is required to make fine adjustments to the size of the orifice and thus only a limited range of spray patterns can be achieved.

An object of the invention, therefore, is to provide an air brush or spray gun which can be finely adjusted without a high degree of skill being called for, and which can easily be controlled for producing an extended range of spray patterns.

According to the present invention, a spray gun or air brush of the type described is provided with manually adjustable cam means adapted to co-operate with a control valve incorporated in the spray jet so as to control the size of the delivery orifice and so as to control variation of the size of the orifice in a predetermined manner.

Preferably the spray jet incorporates a needle valve having a valve needle which is slidably mounted for movement relative to a co-operating valve seat, the orifice being defined between said needle and said seat, and the cam means act on said needle to control the rate and extent of movement imparted to said needle.

By virtue of the cam means, displacement of the valve needle need not be directly proportional to the manual action and by providing the cam with an appropriate cam surface a finer degree of control can be obtained than has hitherto been possible. Thus, a more easily defined spray pattern and a wider range of spray patterns can be produced than is possible when the displacement is linearly related to the manual actuation.

Preferably the cam means is a manually actuated control slide formed with a cam face of the shape required to impart the desired movement to the valve needle. A lever may conveniently be interposed between the control slide the valve needle to amplify the cam face shape variations which are to be transmitted to the needle to displace the same.

The invention will be described further, by way of example, with reference to the accompanying drawings in which:

FIG. 1 is an axial section through an air brush having a cam controlled spray jet assembly embodying the invention; and FIG. 2 is a transverse section showing the cam control means.

The spray jet assembly illustrated in the drawings is shown as being incorporated in an air brush generally designated 10 and which is intended at its rear end to be connected by a flexible tube 11 to a remotely situated pressure air supply. The air brush 10 is formed towards its forward end with a slide chamber 12 wherein is received a slide 14 providing a mounting for one end of a valve needle 16, the other end of which is conically tapered and co-operates with a correspondingly shaped valve seat 18.

Along its upper surface and above the slide chamber 14, the air brush 10 is provided with a keyway 20 within which is seated the complementarily shaped base of a control slide 22. The lower face of the control slide 22 is recessed as indicated at 24 and the surface of the recess 24 constitutes a cam surface against which bears a cam follower roller 26 carried at the upper end of a lever 28. The lever 28 is secured at its lower end upon a pivot 30 traversing the slide chamber 12 and is positioned in a lateral recess 15 of the slide member 14. At the end of the recess 15 remote from the needle 16, the lever 28 rests against the shoulder 17 defined between the recess 15 and the remainder of the slide member.

In operation, the size of the orifice defined between the valve needle 16 and the valve seat 18 is increased as the control slide 22 is moved to the right as viewed in the drawings. Movement of the control slide in this direction takes place against the reaction of a return spring 21 arranged in the rear portion of the air brush 10 and causes the cam surface 24 of the control slide to bear against the cam follower roller 26 which in turn displaces the lever 28 to the right, the maximum displacement of the slide being indicated in FIG. 1 in dotted lines. As will be appreciated, the movement of the lever and hence of the valve needle 16 need not be directly related to movement of the slide 22 but can assume any required relationship to the movement of the control slide 22 dependent upon the configuration of the cam surface 24.

By virtue of the invention, the spray pattern produced by the spray jet may be very finely controlled due to the elongate conical configuration of the valve end of the needle 16 and the movement of the needle 16 itself may be finely controlled by movement of the control slide 22. Thus, a wide range of spray patterns may be very precisely set by movement of the control slide 22 and the spray head 10 may, adjacent the control slide 22, carry a small plate pictorially indicating the nature of the spray jet which may be expected to be produced from a given setting of the slide 22. The ability imparted by the cam surface 24 to exert very fine control on the movement of the valve needle 16 is especially valuable in the initial range of the needle opening movement, which has a greater effect on the spray pattern than does needle movement in the more fully open positions.

For convenience, movement of the control slide 22 to open the valve 16, 18 is also caused to permit pressure air to flow from tube 11, through an axial passage 13 of the brush and past a normally closed check valve 32 positioned adjacent the chamber 12. For this purpose the rearward end of the cam surface 24 is notched at 25 to receive the projecting end of a dolly member 34 which bears against a spring-seated check valve closure member 36, so that as the control slide 22 is moved away from its normal rest position, the notch 25 moves off the dolly member 34 and the latter is depressed to open the closure member 36. Suitable passage means (not shown) are provided in the air brush 10 to conduct the pressure air from the check valve 32 to an annulus 39 defined between a guide block 38 through which the needle 16 passes at the forward end of the brush and an outer nozzle member 41. A radial passage 40 in the guide block 38 communicates with the annulus 39 and with a connector 42 by which the brush is connected to the paint reservoir.

Seating of the valve 16 when the control slide 22 is returned to its normal rest position is accomplished by a return spring 44 arranged between a spring abutment 46 fixed on the needle 16 and a second needle guide block 48 located adjacent the slide chamber 12.

I claim:

1. In the known type of air brush comprising a housing containing a discharge orifice, passageways for supplying air and liquid to said orifice, a needle valve for controlling the flow of liquid to said discharge orifice, and control means to regulate the position of said needle valve with respect to said orifice, the improvement consisting of control means that includes (a) a slide member adapted to slide along an exterior portion of said housing, a portion of the inner surface of said slide member constituting a cam surface, (b) a lever pivotally mounted within said housing, said lever having (1) a first portion that constitutes a cam follower which is adapted to engage said cam surface of said slide member, and (2) a second portion that is adapted to bear against an extension on the inner end of said needle valve so as to move said needle valve to a progressively greater open position in a predetermined manner, (c) means for normally biasing said slide member toward a position wherein the interaction of said cam surface and said cam follower will permit said needle valve to shut off the liquid passageway to said discharge orifice.

* * * * *